US008963407B2

(12) United States Patent
Ochiai et al.

(10) Patent No.: US 8,963,407 B2
(45) Date of Patent: Feb. 24, 2015

(54) SPARK PLUG

(75) Inventors: Satoru Ochiai, Nagakute (JP); Haruki Yoshida, Tajimi (JP); Takamitsu Mizuno, Hashima (JP); Atsushi Tsukada, Yokkaichi (JP)

(73) Assignee: NGK Spark Plug Co., Ltd., Nagoya (JP)

( * ) Notice: Subject to any disclaimer, the term of this patent is extended or adjusted under 35 U.S.C. 154(b) by 30 days.

(21) Appl. No.: 13/978,976

(22) PCT Filed: Feb. 2, 2012

(86) PCT No.: PCT/JP2012/000721

§ 371 (c)(1),
(2), (4) Date: Jul. 10, 2013

(87) PCT Pub. No.: WO2012/105270

PCT Pub. Date: Aug. 9, 2012

(65) Prior Publication Data

US 2013/0285534 A1 Oct. 31, 2013

(30) Foreign Application Priority Data

Feb. 2, 2011 (JP) ..... 2011-020954

(51) Int. Cl.

| | |
|---|---|
| ***H01T 13/16*** | (2006.01) |
| ***H01T 13/20*** | (2006.01) |
| ***H01T 13/05*** | (2006.01) |
| ***H01T 13/34*** | (2006.01) |

(52) U.S. Cl.

CPC ..... *H01T 13/20* (2013.01); *H01T 13/05* (2013.01); *H01T 13/34* (2013.01)

USPC ..... 313/141; 313/118

(58) Field of Classification Search

USPC ..... 313/140, 141, 143, 118

See application file for complete search history.

(56) References Cited

U.S. PATENT DOCUMENTS

| | | | |
|---|---|---|---|
| 5,962,957 | A | 10/1999 | Tanaka et al. |
| 2005/0242694 | A1 | 11/2005 | Honda et al. |

FOREIGN PATENT DOCUMENTS

| | | | |
|---|---|---|---|
| CN | 1694323 | A | 11/2005 |
| CN | 201219174 | Y | 4/2009 |
| EP | 0798833 | A | 10/1997 |
| JP | 02-165587 | A | 6/1990 |
| JP | 08-315954 | A | 11/1996 |
| JP | 09-266055 | A | 10/1997 |

OTHER PUBLICATIONS

International Search Report mailed Apr. 17, 2012 for the corresponding PCT Application No. PCT/JP2012/000721.

Chinese Office Action mailed Jul. 7, 2014 for the corresponding Chinese Application No. 201280007532.7.

*Primary Examiner* — Joseph L Williams

(74) *Attorney, Agent, or Firm* — Leason Ellis LLP.

(57) ABSTRACT

A spark plug includes an insulator having an axial hole, a first inner circumferential surface, a second inner circumferential surface whose diameter is greater than that of the first inner circumferential surface, and a ledge portion connecting the first and the second inner circumferential surfaces. The spark plug also includes a center electrode having a large-diameter portion, a projection portion, and a circular columnar leg portion that projects into a space surrounded by the first inner circumferential surface. The spark plug includes a seal portion which fixes the center electrode within the axial hole. When $C<A$, $A-C \leq B-A$, where A represents a diameter of an imaginary cylinder having the minimum diameter required for surrounding the projection portion, B represents a maximum diameter of the large-diameter portion, and C represents an average diameter of the leg portion present in the space surrounded by the first inner circumferential surface.

1 Claim, 7 Drawing Sheets

SPARK PLUG

CROSS-REFERENCE TO RELATED PATENT APPLICATIONS

This application is a U.S. National Phase Application under 35 U.S.C. §371 of International Patent Application No. PCT/JP2012/000721, filed Feb. 2, 2012, and claims the benefit of Japanese Patent Application No. 2011-020954, filed Feb. 2, 2011, all of which are incorporated by reference in their entities herein. The International. Application was published in Japanese on Aug. 9, 2012 as International Publication No. WO/2012/105270 under PCT Article 21(2).

FIELD OF THE INVENTION

The present invention relates to a spark plug used for igniting an internal combustion engine.

BACKGROUND OF THE INVENTION

In general, a spark plug used for igniting an internal combustion engine such an automotive engine includes a tubular metallic shell; a tubular insulator disposed in the bore of the metallic shell; a center electrode disposed in a forward end portion of the axial hole of the insulator; a metallic terminal disposed in a rear end portion of the axial hole; and a ground electrode whose one end is joined to the forward end of the metallic shell and whose other end faces the center electrode so as to form a spark discharge gap.

The center electrode has a leg portion disposed in the forward end portion of the axial hole, and a large-diameter portion located rearward of the leg portion and having a diameter grater than that of the leg portion. The center electrode is disposed such that the large-diameter portion is supported by a ledge portion of the insulator at which the diameter of the axial hole changes. In some cases, the center electrode has a projection portion which is located rearward of the large diameter portion and which has a diameter smaller than that of the large-diameter portion. A seal is provided around the large-diameter portion and the projection portion; i.e., in the space between the insulator and the large-diameter portion and projection portion of the center electrode. This seal fixes the center electrode within the axial hole.

Patent Document 1 discloses a spark plug in which charging of the seal is improved so as to enhance the shock resistance of the center electrode to a sufficient degree; specifically, a "spark plug which satisfies relational expressions $13 \leq B/A \leq 40$ and $10 \leq C/A \leq 35$, where B represents the distance between the peripheral edge of the center electrode and an end of a parallel groove formed on a head portion of the center electrode and crossing the head portion in the diametrical direction, and C represents the height of a projection which is formed on the head portion of the center electrode as a result of formation of the parallel groove" (see claim 1 of Japanese Patent Application Laid-Open (kokai) No. H9-266055).

In order to fix the center electrode within the axial hole in a good condition, it is desired that the seal be uniformly provided around the center electrode. However, a problem arises when the shape of the projection portion of the center electrode is not axisymmetric with respect to the axis of the center electrode; for example, when the axis of the circular columnar projection portion deviates from the axis of the center electrode in the radial direction. Specifically, since the space between the center electrode and the insulator is not formed uniformly in the circumferential direction, the seal may have a thick portion and a thin portion. As a result, when a resultant spark plug is used on an actual engine, because of vibration, thermal expansion caused by high temperature, or other causes, the center electrode may rattle within the axial hole, while the thin portion of the seal serves as a weak point.

SUMMARY OF THE INVENTION

An object of the present invention is to provide a spark plug which has a center electrode having a reduced eccentricity (which represents the deviation between the axis of a projection portion of the center electrode and the axis of a leg portion thereof) and a reduced hollow depth (which represents the depth of a hollow formed on the side surface of the projection portion), whereby a seal is formed around the projection portion uniformly in the circumferential direction, and the center electrode can be fixed within the axial hole in a good condition.

Means for solving the above-described problems is as follows.

A spark plug comprising:

an insulator having; an axial hole extending in a direction of an axis, a first inner circumferential surface which forms a forward end portion of the axial hole, a second inner circumferential surface which forms a rear end portion of the axial hole and which has a diameter greater than that of the first inner circumferential surface, and a ledge portion which connects the first inner circumferential surface and the second inner circumferential surface;

a center electrode which is formed by plastic working, said center electrode having; a large-diameter portion supported by the ledge portion, a projection portion projecting rearward from the large-diameter portion, and a circular columnar leg portion which is located adjacent to the large-diameter portion and projects into a space surrounded by the first inner circumferential surface; and a seal portion which fixes the center electrode within the axial hole, wherein, when $C<A$, $A-C \leq B-A$ where A represents a diameter (mm) of an imaginary cylinder having the minimum diameter required for surrounding the projection portion, B represents a maximum diameter (mm) of the large-diameter portion, and C represents an average diameter (mm) of the leg portion present in the space surrounded by the first inner circumferential surface, and when a value (L'/C) obtained by dividing an axial length L' of the projection portion along an axis by the average diameter C of the leg portion is 1 or greater, an upsetting ratio $(L-L')/L \times 100(\%)$ is 13% or less, where the upsetting ratio being the ratio of the difference (L−L') between a pre-formation projection portion length L and the axial length L' of the projection portion to the pre-formation projection portion length L, and the pre-formation projection portion length L being a value (V/D) obtained by dividing a volume V of the projection portion by a cross-sectional area D of the leg portion.

Effects of the Invention

According to the spark plug of the present invention, when $C<A$, $A-C \leq B-A$. Therefore, the center electrode has a reduced eccentricity (which represents the deviation between the axis of the projection portion of the center electrode and the axis of the leg portion thereof) and a reduced hollow depth (which represents the depth of a hollow formed on the side surface of the projection portion. Thus, the seal can be formed around the projection portion such that it becomes uniform in the circumferential direction. As a result, there can be provided a spark plug in which the center electrode is fixed to the wall surface of the axial hole in a good condition.

According to the spark plug of the present invention, when a value (L'/C) obtained by dividing the axial length L' of the projection portion by the average diameter C of the leg portion is 1 or greater, an upsetting ratio (L−L')/L×100(%) is 13% or less. Therefore, the eccentricity and the hollow depth can be reduced further. As a result, there can be provided a spark plug in which the center electrode is fixed to the wall surface of the axial hole in a better condition.

BRIEF DESCRIPTION OF THE DRAWINGS

These and other, features and advantages of the present invention will become more readily appreciated when considered in connection with the following detailed description and appended drawings, wherein like designations denote like elements in the various views, and wherein.

DETAILED DESCRIPTION OF THE INVENTION

Modes for Carrying Out the Invention

Figure 1:
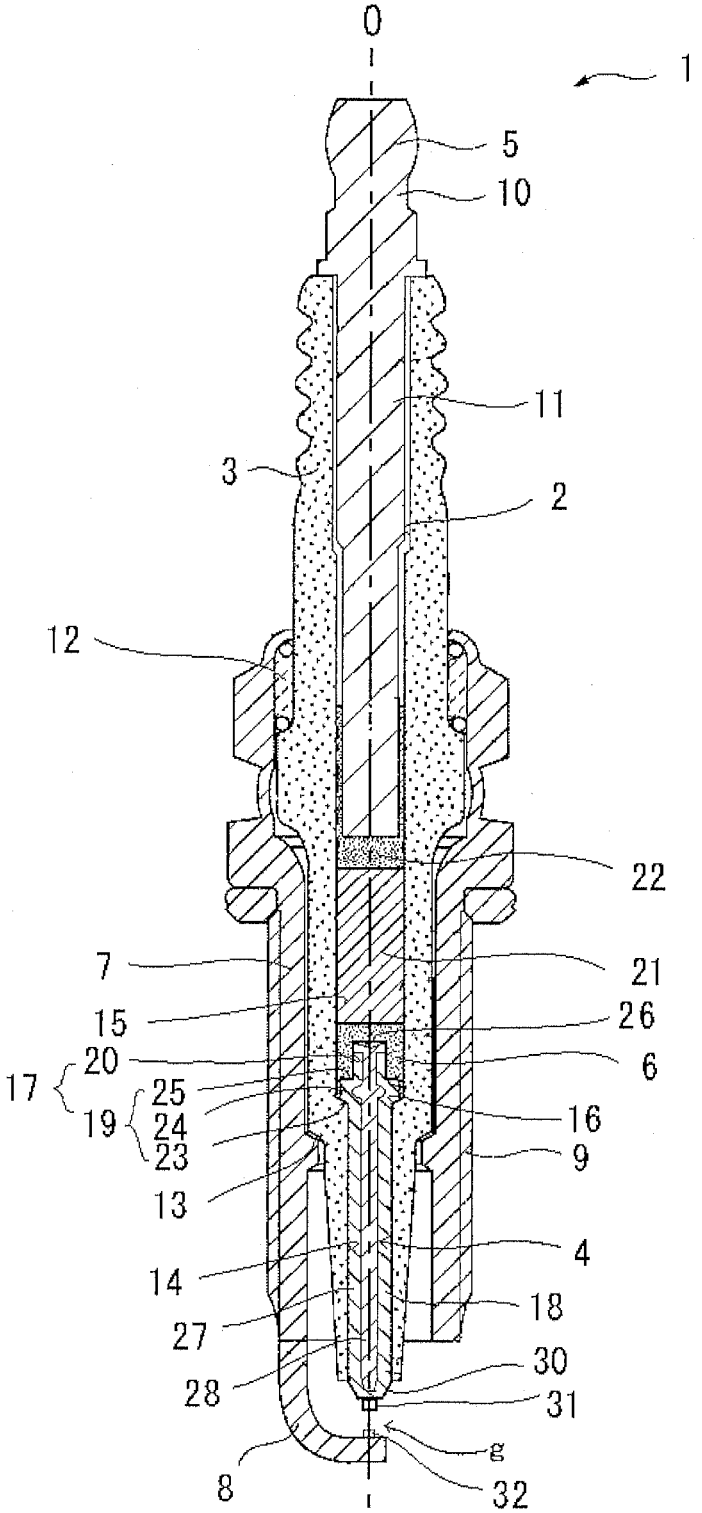
FIG. 1 is an explanatory cross-sectional view showing the entirety of a spark plug which is one embodiment of a spark plug according to the present invention.

FIG. 1 shows a spark plug which is one embodiment of a spark plug according to the present invention. FIG. 1 is an explanatory view showing a cross section of the entirety of a spark plug 1 which is one embodiment of the spark plug according to the present invention. In FIG. 1, the axis of an insulator is denoted by O. In the following description, the lower side of the sheet on which FIG. 1 is drawn will be referred to as the forward end side along the axis O, and the upper side of the sheet on which FIG. 1 is drawn will be referred to as the rear end side along the axis O.

This spark plug 1 includes an insulator 3 which has an axial hole 2 extending in the direction of the axis O; a center electrode 4 which is fixed in a forward end portion of the axial hole 2 by a seal 6; a metallic terminal 5 which is disposed in a rear end portion of the axial hole 2; a metallic shell 7 which accommodates the insulator 3; and a ground electrode 8 whose one end is joined to a forward end surface of the metallic shell 7 and whose other end faces the center electrode 4 with a gap g formed therebetween.

The metallic shell 7 has a generally cylindrical shape and is formed to accommodate and hold the insulator 3. A screw portion 9 is formed on the outer circumferential surface of a forward end portion of the metallic shell 7. The spark plug 1 is attached to the cylinder head of an unillustrated internal combustion engine through use of the screw portion 9. The metallic shell 7 may be formed of an electrically conductive steel material such as low-carbon steel. Preferably, the screw portion 9 has a size of M12 or less in order to decrease the diameter thereof.

The ground electrode 8 is formed into, for example, a generally prismatic shape. The ground electrode 8 is joined at its one end to the forward end surface of the metallic shell 7, and is bent in the middle to have a generally L-like shape. The shape and structure of the ground electrode 8 are designed such that its distal end portion faces a forward end portion of the center electrode 4 with the gap g formed therebetween. The ground electrode 8 is formed of the same material as that of the center electrode 4.

The metallic terminal 5 is used to externally apply to the center electrode 4 a voltage for generating spark discharge between the center electrode 4 and the ground electrode 8. The metallic terminal 5 has a flange portion 10 and a rod-shaped portion 11. The flange portion 10 has an outer diameter greater than the diameter of the axial hole 2, is exposed from the axial hole 2, and is partially in contact with the end surface of the insulator 3 located on the rear side with respect to the direction of the axis O. The rod-shaped portion 11 has a substantially circular columnar shape, extends forward from the end surface of the flange portion 10 located on the forward side with respect to the direction of the axis O, and is accommodated within the axial hole 2. The metallic terminal 5 is formed of, for example, low-carbon steel or the like, and a nickel layer is formed on the surface of the metallic terminal 5 through plating or the like.

The insulator 3 is held inside the metallic shell 7 via talc 12, a packing 13, etc. The insulator 3 has a first inner circumferential surface 14 which forms a forward end portion of the axial hole 2, a second inner circumferential surface 15 which forms a rearward end portion of the axial hole 2 and has a diameter greater than that of the first inner circumferential surface 14, and a ledge portion 16 which connects the first inner circumferential surface 14 and the second inner circumferential surface 15. The insulator 3 is fixed to the metallic shell 7 such that a forward end portion of the insulator 3 projects from the forward end surface of the metallic shell 7. The insulator 3 is desirably formed of a material which is sufficiently high in mechanical strength, thermal strength, electrical strength, etc. An example of such a material is a ceramic sintered body containing alumina as a main component.

The center electrode 4 has a head portion 17 supported by the ledge portion 16, and a leg portion 18 which has a generally circular columnar shape, is located adjacent to the head portion 17, and projects into the space surrounded by the first inner circumferential surface 14. The center electrode 4 is held such that it is electrically insulated from the metallic shell 7 and its forward end projects from the forward end surface of the insulator 3. The head portion 17 has a large-diameter portion 19 which is larger in diameter than the leg portion 18 and is supported by the ledge portion 16, and a projection portion 20 which is smaller in diameter than the large-diameter portion 19 and projects rearward from the rear end of the large-diameter portion 19.

The large-diameter portion 19 has a diameter increasing portion 23, a largest diameter portion 24, and a diameter decreasing portion 25 in this order from the forward end side with respect to the direction of the axis O. The projection portion 20 is adjacently provided on the rear end side of the diameter decreasing portion 25. The diameter increasing portion 23 is supported by the ledge portion 16, whereby the center electrode 4 is fixed within the axial hole 2. In the present embodiment, the diameter increasing portion 23 is tapered, the largest diameter portion 24 has a circular columnar outer circumferential surface, and the diameter decreasing portion 25 is a flat surface which is orthogonal to the axis O and which connects the circular columnar largest diameter portion 24 and the circular columnar projection portion 20, which is smaller in outer diameter than the largest diameter portion 24.

In the present embodiment, the projection portion 20 has a circular columnar shape, and a concave portion 26 having an inverted conical shape is formed at an end portion of the projection portion 20 opposite the large-diameter portion 19. Since the concave portion 26 increases the area of contact between the seal 6 and the head portion 17, the seal 6 and the head portion 17 easily bond together.

The leg portion 18 has a rod-shaped portion which has a circular columnar shape, located adjacent to the large-diameter portion 19, and projects into the space surrounded by the first inner circumferential surface 14; an intermediate-diameter portion which is located adjacent to the rod-shaped portion and is smaller in outer diameter than the rod-shaped portion; a small-diameter portion which is located adjacent to the intermediate-diameter portion and is smaller in outer diameter than the intermediate-diameter portion; and a forward end portion 30 which is located adjacent to the small-diameter portion and whose outer diameter decreases from the outer diameter of the small-diameter portion so as to form a truncated conical shape. In the present embodiment, the entire forward end portion 30 is exposed from the forward end surface of the insulator 3. However, only a part of the forward end portion 30 may be exposed from the forward end surface of the insulator 3, or a part of the small-diameter portion and the entire forward end portion 30 may be exposed from the forward end surface of the insulator 3.

The center electrode 4 is desirably formed of a material having a sufficient thermal conductivity, a sufficient mechanical strength, etc. For example, the center electrode 4 is formed of a nickel alloy such as Inconel (trademark) 600. The structure of the center electrode 4 is not limited to a single-body structure made of a single type of material such as a nickel alloy. The center electrode 4 may have a double-layer structure having an outer layer 27 which is made of a nickel alloy or the like and an inner layer 28 which is surrounded by the outer layer 27 and is made of a material having a heat conductivity higher than that of the outer layer 27. Alternatively, the center electrode 4 may have a layered structure which includes an outer layer, an inner layer surrounded by this outer layer, and at least one layer surrounded by the inner layer and in which the layers adjacent to each other are made of different materials. Examples of the material used to form the inner layer 28 include Cu, Cu alloy, Ag, and Ag alloy.

The seal 6 is provided in the space surrounded by the ledge portion 16, the second inner circumferential surface 15, and the head portion 17, whereby the seal 6 fixes the center electrode 4 within the axial hole 2. The seal 6 can be formed by sintering seal powder which contains powder of glass such as borosilicate glass and powder of metal such as Cu, Fe, etc. In general, the seal 6 has a resistance of several hundreds mΩ or smaller.

A resistor 21 is provided between the center electrode 4 and the metallic terminal 5 via the seal 6. The resistor 21 electrically connects the center electrode 4 and the metallic terminal 5 together, and prevents generation of radio noise. The resistor 21 can be formed by sintering a resistor composition which contains powder of glass such as borosilicate glass, powder of ceramic such as $ZrO_2$, non-metallic conductive powder such as carbon black, and/or powder of metal such as Zn, Sb, Sn, Ag, Ni, etc. In general, the resistor 21 has a resistance of 100Ω or lager.

In the present embodiment, a second seal 22, which is formed of the same material as that of the seal 6, is provided between the resistor 21 and the metallic terminal 5, whereby the metallic terminal 5 is fixed to the insulator 3 in a sealed state. The second seal 22 is provided when necessary. When the second seal 22 is not provided, the metallic terminal 5 is fixed to the insulator 3 in a sealed state by the resistor 21.

Figure 2:
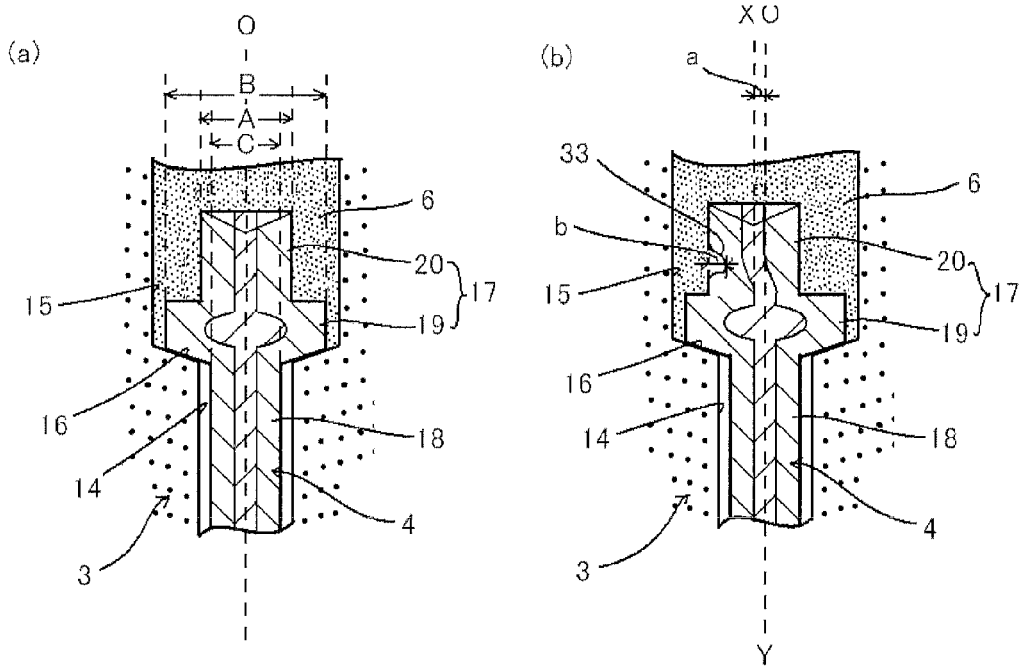
FIG. 2 is an explanatory cross-sectional view showing a main portion of the spark plug which is one embodiment of the spark plug according to the present invention.

As shown in FIG. 2(*a*), when C<A, the present spark plug has a relational expression A−C≤B−A, where A (mm) represents the diameter of an imaginary cylinder having the minimum diameter required for surrounding the projection portion 20, B (mm) represents the maximum diameter of the large-diameter portion 19, and C (mm) represents the average diameter of the leg portion 18. In other words, when the projection portion 20 is thicker than the leg portion 18, the difference between the diameter of the large-diameter portion 19 and that of the projection portion 20 is grater than the difference between the diameter of the projection portion 20 and that of the leg portion 18. When the above-mentioned relational expression is satisfied, as shown in FIG. 2(*b*), the center electrode 4 has a reduced eccentricity a, which represents the deviation between the axis X of the projection portion 20 of the center electrode 4 and the axis Y of the leg portion 18 thereof, and a reduced hollow depth b, which represents the depth of a hollow 33 formed on the side surface of the projection portion 20.

When the center electrode 4 and the insulator 3 are assembled in a process of manufacturing the spark plug, the center electrode 4 inserted into the axial hole 2 is disposed such that the axis Y of the leg portion 18 and the axis O of the insulator 3 coincide with each other. When a center electrode having a large eccentricity a is disposed, the axis X of the projection portion 20 greatly deviates from the axis O of the insulator 3. Therefore, the space formed between the projection portion 20 and the second inner circumferential surface 15 has a wide portion and a narrow portion; i.e., the space becomes eccentric in the radial direction. Seal powder for forming the seal 6 is charged into this space, and is heated and compressed, whereby the seal 6 is formed, and the center electrode 4 is fixed within the axial hole 2 by the seal 6. If the space is not uniformly formed around the axis O and has a narrow portion, the amount of the seal powder charged into the narrow portion decreases, and the adhesion force of the center electrode 4 to the insulator 3 becomes weak at the narrow portion. The same phenomenon also occurs when a hollow 33 is formed on the side surface of the projection portion 20. Namely, when a hollow 33 is present on the side surface of the projection portion 20 as shown in FIG. 2(*b*), the charging amount of the seal powder increases in a region of the space corresponding to the hollow 33; however, the charging amount of the seal powder decreases in the remaining region of the space. Since the seal 6 is not uniformly formed around the center electrode 4, the center electrode 4 is not uniformly fixed to the insulator 3 along the circumferential direction, whereby a region of the space in which the amount of the seal 6 is relatively small becomes a weak point. As a result, when a resultant spark plug is used on an actual engine, because of vibration, thermal expansion caused by high temperature, or other causes, the center electrode 4 may rattle within the axial hole 2.

In contrast, according to the spark plug of the present invention, the center electrode 4 has a reduced eccentricity a and a reduced hollow depth b. Therefore, after assembly of the center electrode 4 into the insulator 3, a space which is uniform around the axis O can be formed between the projection portion 20 and the second inner circumferential surface 15. This enables the seal powder to be charged into the space such that is becomes uniformly in the circumferential direction. Therefore, it is possible to provide a spark plug in which the center electrode 4 is fixed to the wall surface of the axial hole 2 in a good condition.

When A−C≤B−A (C<A), the center electrode 4 having a reduced eccentricity a and a reduced hollow depth b can be formed because of the setup in a process of manufacturing the center electrode 4. Accordingly, in order to facilitate the understanding of the present invention, first, an example method of manufacturing the spark plug 1 will now be described, while the focus will be on a method of manufacturing the center electrode 4.

Figure 3:
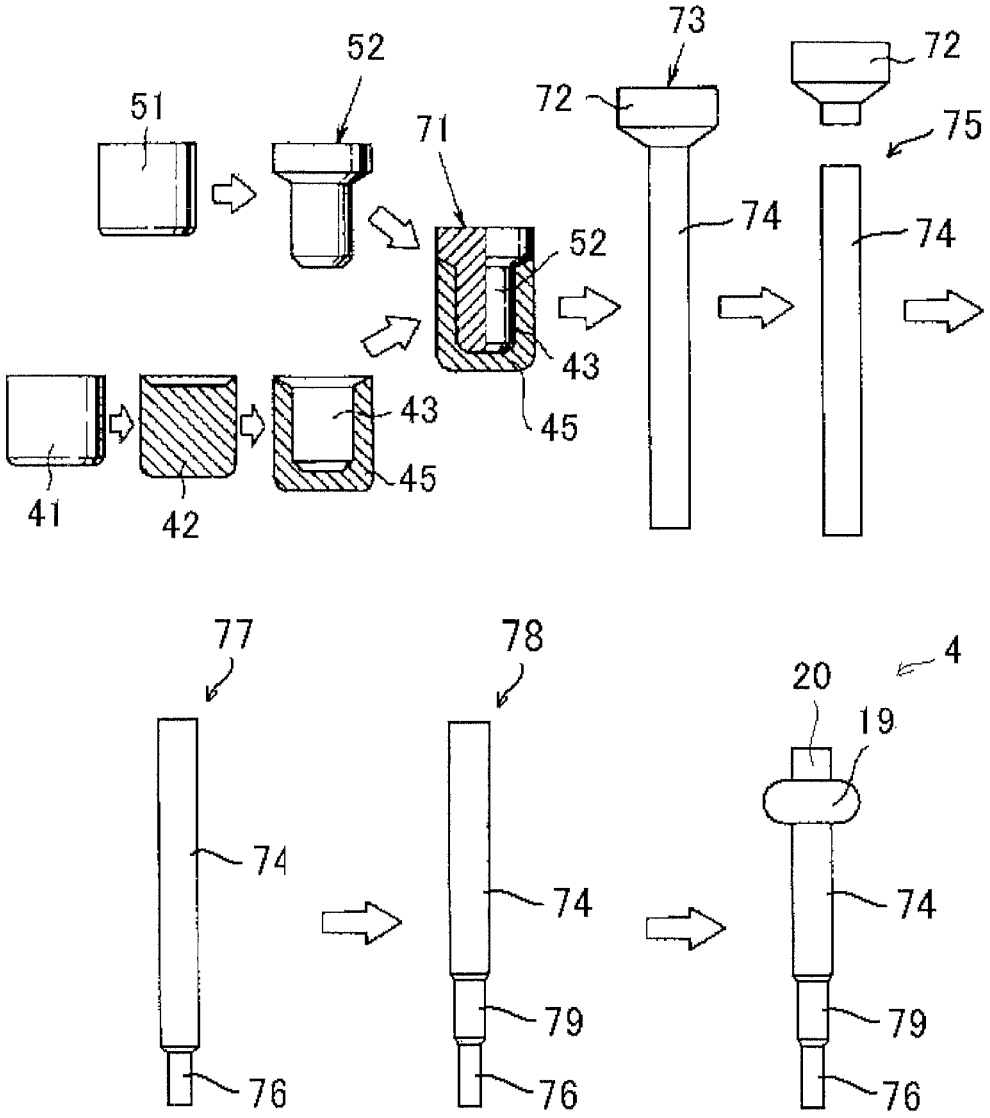
FIG. 3 is a set of views showing an example process of manufacturing a center electrode according to the present invention.
Figure 4:
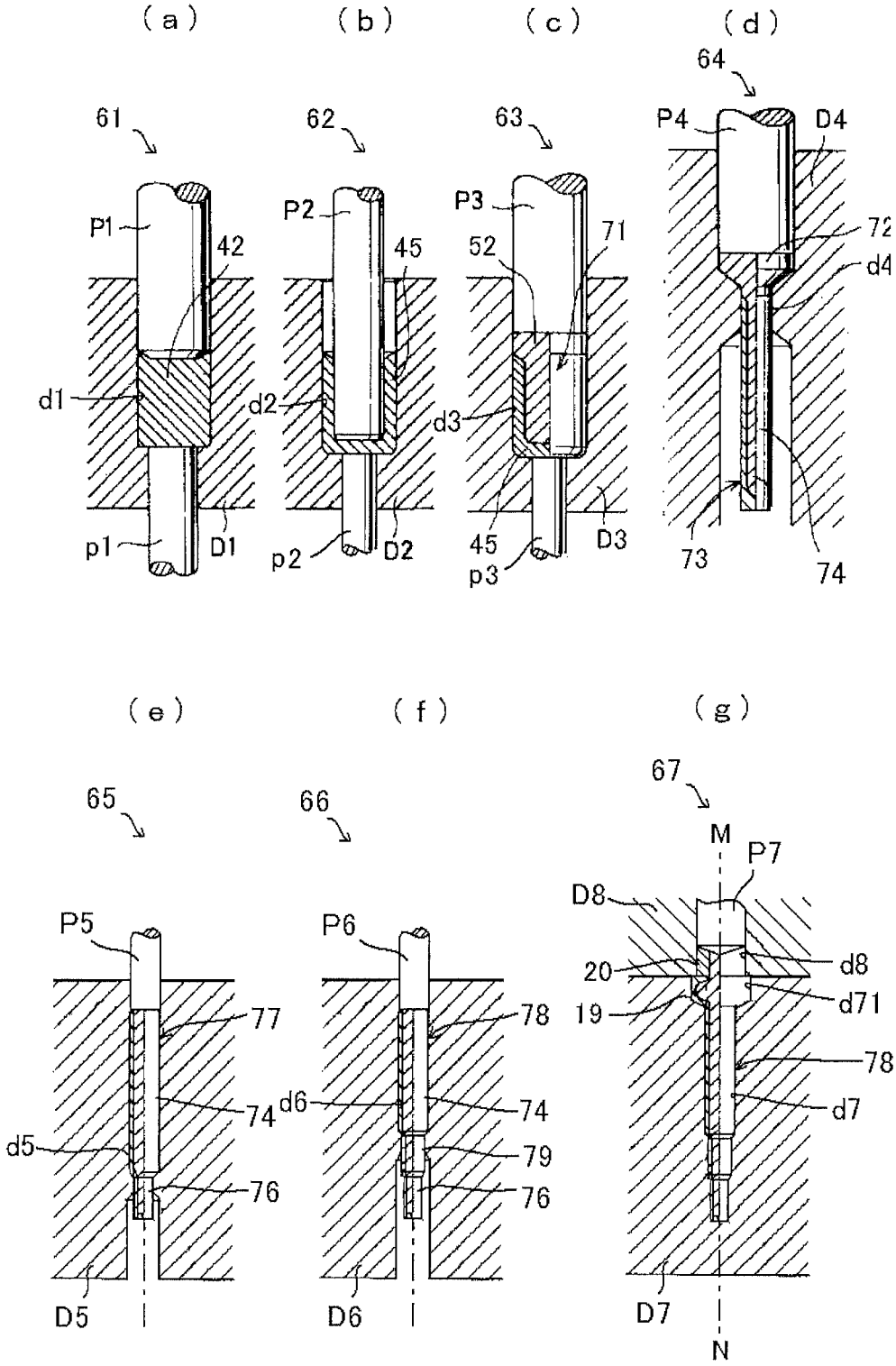
FIG. 4 is another set of views showing the example process of manufacturing a center electrode according to the present invention.

FIGS. 3 and 4 are explanatory views showing the process of manufacturing the center electrode. First, a wire rod made of a nickel alloy such as Inconel 600 for forming the center electrode is cut into a predetermined length, and opposite end surfaces of the cut piece of the wire rod are struck such that the opposite end surfaces become flat, whereby a circular columnar shell member 41 is formed. Next, this circular columnar shell member 41 is cold-forging by a forging apparatus 61 shown in section (a) of FIG. 4, which is composed of a die D1, a punch P1, and a pin p1. Specifically, the circular columnar shell member 41 is inserted into a round hole d1 of the die D1, and is punched by the punch P1 such that a recess is formed. As a result, an intermediate shell member 42 is formed. The intermediate shell member 42 has a circular columnar sectional shape, has a shallow recess on the upper end surface, and is rounded along the periphery of the lower end surface. The pin p1 is a kickout pin for ejecting the formed intermediate shell member 42 from the round hole d1 of the die D1.

The intermediate shell member 42 is again cold-forging by a forging apparatus 62 shown in section (b) of FIG. 4, which is composed of a die D2, a punch P2, and a pin p2. Specifically, the intermediate shell member 42 is inserted into a round hole d2 of the die D2, and is punched by the punch P2 such that a recess is formed. As a result, a cup-shaped shell member 45 having a deep recess 43 is formed. The pin p2 is a kickout pin for ejecting the formed cup-shaped shell member 45 from the round hole d2 of the die D2.

Meanwhile, a wire rod made of a metal which is excellent in thermal conductivity such as Cu, Cu alloy, Ag, or Ag alloy is cut into a predetermined length, and opposite end surfaces of the cut piece of the wire rod are struck such that the opposite end surfaces become flat, whereby a circular columnar core member 51 is formed. Next, this circular columnar core member 51 is cold-forging so as to form a circular columnar core member 52 having a head portion. Next, as shown in section (c) of FIG. 4, a combined body obtained by loosely fitting the headed circular columnar core member 52 into the recess 43 of the cup-shaped shell member 45 is inserted into a round hole d3 of a die D3, and is parallel-punched by the punch P3, whereby a first combined body 71 shown in FIG. 3 is formed. The pin p3 is a kickout pin for ejecting the formed first combined body 71 from the round hole d3 of the die D3.

As shown in section (d) of FIG. 4, this first combined body 71 is inserted into a round hole d4 of a die D4, and is pushed forward by the punch P4 for forward extrusion such that a forward end portion of the first combined body 71 has a reduced diameter. Thus, a round-bar-shaped extrudate 73 shown in FIG. 3 is formed. This extrudate 73 has a rod-shaped portion 74 on the forward end side thereof. The rod-shaped portion 74 has the shape of a round bar and an outer diameter smaller than that of the first combined body 71. The extrudate 73 also has a rear end portion 72 which did not undergo the forward extrusion and which still has a large diameter.

Next, a portion of the extrudate 73 including the rear end portion 72 is cut so as to form a second combined body 75 having the rod-shaped portion 74 shown in FIG. 3.

Subsequently, as shown in section (e) of FIG. 4, the second combined body 75 is inserted into a round hole d5 of a die D5, and is pushed forward by the punch P5 for forward extrusion such that the diameter of the rod-shaped portion 74 of the second combined body 75 decreases. Thus, a third combined body 77 having a step shown in FIG. 3 is formed. A round-bar-shaped small-diameter portion 76 which is smaller in outer diameter than the rod-shaped portion 74 is formed on the forward end side of the rod-shaped portion 74 of the third combined body 77.

Next, as shown in section (f) of FIG. 4, the third combined body 77 is inserted into a round hole d6 of a die D6, and is pushed by the punch P6 for intrusion forming such that the diameter of a forward end portion of the rod-shaped portion 74 of the third combined body 77 decreases. As a result, a fourth combined body 78 with two steps shown in FIG. 3 is formed. A round-rod-shaped intermediate diameter portion 79 which is smaller in outer diameter than the rod-shaped portion 74 and is larger in outer diameter than the small-diameter portion 76 is formed between the rod-shaped portion 74 and the small-diameter portion 76 of the fourth combined body 78.

Next, as shown in section (g) of FIG. 4, the fourth combined body 78 is inserted into a round hole d7 of a die D7 such that a portion of the fourth combined body 78 projects from the rear end of the die D7. The die D7 has a round hole d71 which is located rearward of the round hole d7 and is greater in diameter than the round hole d7. Next, a die D8 is disposed such that the portion of the fourth combined body 78 projecting from the rear end of the die D7 is inserted into a round hole d8 of the die D8. At that time, the die D8 is disposed such that the axis N of the round hole d7 of the die D7 coincides with the axis M of the round hole d8 of the die D8. Notably, the diameter of the round hole d8 is greater than that of the round hole d7 and is smaller than that of the round hole d71. Next, the fourth combined body 78 is pressed by the punch P7 until the rear end portion of the fourth combined body 78 plastically deforms and fills the round hole d71 of the die D7. Thus, the large-diameter portion 19 and the projection portion 20 are formed at the rear end of the fourth combined body 78. In this manner, the center electrode 4 is formed.

In the example method of manufacturing the center electrode, the center electrode is composed of the outer layer 27 and the inner layer 28. However, a center electrode in which the inner layer is composed of two or more layers and a center electrode formed of a single type of material can be formed by a similar method.

Meanwhile, the ground electrode 8, the metallic shell 7, the metallic terminal 5, and the insulator 3 are manufactured by known methods such that they have predetermined shapes.

The center electrode 4 is inserted into the axial hole 2 of the insulator 3, and the diameter increasing portion 23 of the center electrode 4 is brought into engagement with the ledge portion 16 of the axial hole 2. As a result, the leg portion 18 is disposed in the space surrounded by the first inner circumferential surface 14, and the head portion 17 is disposed in the space surrounded by the second inner circumferential surface 15. At this time, since the diameter of the leg portion 18 is slightly smaller than the diameter of the space surrounded by the second inner circumferential surface 14, there is formed a clearance which enables the center electrode 4 to be inserted into the axial hole 2. Accordingly, the center electrode 4 can be disposed within the axial hole 2 such that the axis Y of the leg portion 18 substantially coincides with the axis O of the insulator 3.

Subsequently, the seal powder for forming the seal 6, the resistor composition for forming the resistor 21, and the seal powder for forming the second seal 22 are charged, in this order, into the axial hole 2 from the rear end thereof, and a press pin is inserted into the axial hole 2 so as to perform preliminary compression under a pressure of 60 $N/mm^2$ or higher. In the spark plug of the present invention, since the center electrode 4 has a reduced eccentricity a and a reduced hollow depth b, a space which is uniform around the axis O is formed between the projection portion 20 and the second inner circumferential surface 15. Therefore, the seal powder can be charged into this space such that it becomes uniform in the circumferential direction.

Next, the rod-shaped portion 11 of the metallic terminal 5 is inserted into the axial hole 2 from the rear end side thereof, and the metallic terminal 5 is disposed such that the rod-shaped portion 11 comes into contact with the seal powder.

Subsequently, while the seal powder and the resistor composition are heated for 3 to 30 minutes at a temperature (e.g., 800 to 1000° C.) equal to or higher than the glass softening point of glass powder contained in the seal powder, the metallic terminal 5 is pressed until the forward end surface of the flange portion 10 of the metallic terminal 5 comes into contact with the rear end surface of the insulator 3. In this manner, the seal powder and the resistor composition are compressed and heated.

Thus, the seal powder and the resistor composition are sintered, whereby the resistor 21, the seal 6, and the second seal 22 are formed, and the seal 6 and the second seal 22 fix the center electrode 4 and the metallic terminal 5 within the axial hole 2 in a sealed condition. According to the present invention, the seal 6 is formed between the center electrode 4 and the second inner circumferential surface 15 such that it becomes uniform in the circumferential direction. Therefore, there can be provided a spark plug in which the center electrode 4 is fixed to the wall surface of the axial hole 2 in a good condition.

Next, the insulator 3, to which the center electrode 4, the metallic terminal 5, etc. have been fixed, is assembled to the metallic shell 7 having the ground electrode 8 joined to the forward end surface thereof by laser welding or the like.

Finally, a distal end portion of the ground electrode 8 is bent toward the center electrode 4 such that the distal end of the ground electrode 8 faces the forward end of the center electrode 4, whereby the spark plug 1 is manufactured.

The center electrode formed by plastic working as described above can have a reduced eccentricity a and a reduced hollow depth b when $A-C \leq B-A$ ($C<A$).

The center electrode 4 of the spark plug of the present invention rests on the premise that $C<A$; i.e., the diameter of the projection portion 20 is greater than that of the leg portion 18. In the case where $C>A$ (i.e., the diameter of the projection portion 20 is smaller than that of the leg portion 18), a step of rendering the projection portion thinner than the leg portion must be added to the above-described process of forming the center electrode 4. Accordingly, the center electrode 4 of the spark plug of the present invention is formed to satisfy the relation $C<A$ from the viewpoint of simplifying the process of manufacturing the center electrode 4. In the case where $C=A$ (i.e., the diameter of the projection portion 20 is equal to that of the leg portion 18), in the step of forming the projection portion 20 and the large-diameter portion 19, there arises a possibility that the fourth combined body 78 buckles when the die D8 is disposed such that the fourth combined body 78 projecting from the upper end of the die D7 is inserted into the round hole d8 of the die D8.

Data obtained from an experiment to be described later show the fact that the eccentricity and the hollow depth b decrease when the center electrode 4 satisfies the relation $A-C \leq B-A$ ($C<A$). The fact that the eccentricity and the hollow depth b can be adjusted by changing the shape of the center electrode can be qualitatively explained as follows.

Figure 5:
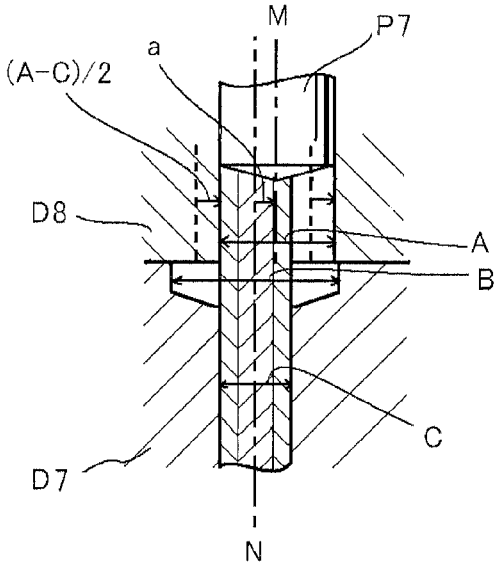
FIG. 5 is an explanatory view used for explaining eccentricity.

There is a possibility that the greater the value of (A−C); i.e., the greater the degree to which the projection portion 20 is thicker than the leg portion 18, the greater the eccentricity a. In the step of forming the projection portion 20 and the large-diameter portion 19 as shown in section (g) of FIG. 4, the fourth combined body 78 is first inserted into the round hole d7 of the die D7, and the die D8 is then disposed such that the round hole d8 of the die D8 accommodates the portion of the fourth combined body 78 projecting from the rear end of the die D7. At that time, the die D8 is disposed such that the axis N of the round hole d7 of the die D7 coincides with the axis M of the round hole d8 of the die D8. However, in some cases, the die D8 cannot be disposed such that the axis N perfectly coincides with the axis M. However, even in the case where the die D8 is disposed such that the axis N and the axis M do not coincide with each other and deviate from each other as shown in FIG. 5, since the portion of the fourth combined body 78 projects from the rear end of the die D7, the wall surface of the round hole d8 of the die D8 and the fourth combined body 78 come into contact with each other, and the axes do not deviate further. Namely, the maximum deviation between the axis N and the axis M is (A−C)/2. If the die D8 is disposed such that the axis N of the die D7 and the axis M of the die D8 deviate from each other, the deviation determines the eccentricity a, which represents the deviation between the axis Y of the leg portion 18 and the axis X of the projection portion 20. Accordingly, since there is the possibility that the deviation between the axis N and the axis M increases with the value of (A−C), the eccentricity a can be reduced by decreasing the value of (A−C).

Figure 6:
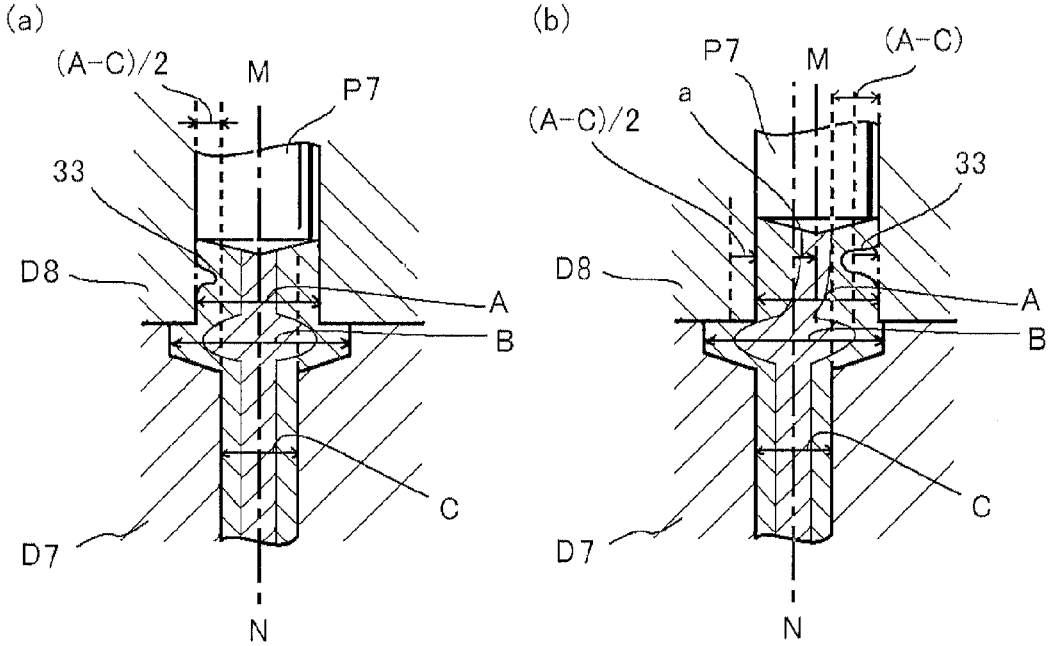
FIG. 6 is a pair of explanatory views used for explaining hollow depth.

There is a possibility that the greater the value of (A−C); i.e., the greater the degree to which the projection portion 20 is thicker than the leg portion 18, the greater the hollow depth b. In the step of forming the projection portion 20 and the large-diameter portion 19 as shown in section (g) of FIG. 4, after the fourth combined body 78 is inserted into the round hole d7 of the die D7 and the die D8 is disposed thereon, the fourth combined body 78 is pressed by the punch P7 until the rear end portion of the fourth combined body 78 plastically deforms and fills the round hole d71. At that time, as shown in FIG. 6, if the fourth combined body 78 is not plastically deformed such that the round hole d8 of the die D8 is completely filled, a hollow 33 may be formed on the side surface of the projection portion 20. As shown in FIG. 6(*a*), in the case where the die D8 is disposed such that the axis N and the axis M coincide with each other, the maximum value of the hollow depth b becomes (A−C)/2. As shown in FIG. 6(*b*), in the case where the fourth combined body 78 is pressed by the punch P7 in a state in which the axis N and the axis M deviate from each other by, for example, (A−C)/2, the maximum value of the hollow depth b becomes (A−C). In either case, there is a possibility that the hollow depth b increases with the value of (A−C), and the hollow depth b can be reduced by decreasing the value of (A−C).

Figure 7:
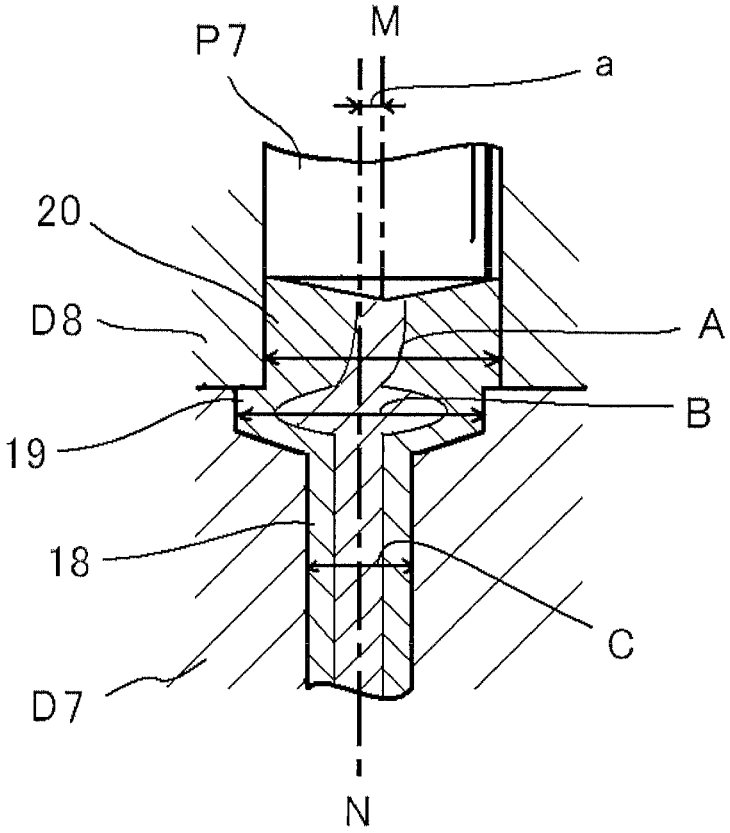
FIG. 7 is an explanatory view showing the case where the axis of a die D8 deviates from the axis of a die D7.

The value of (B−A) is greater than 0, and is preferably a somewhat larger value. Namely, in the case where the diameter of the large-diameter portion 19 is equal to or only slightly greater than that of the projection portion 20, in the step of forming the projection portion 20 and the large-diameter portion 19, there arises a possibility that the projection portion 20 radially projects from the side surface of the large-diameter portion 19 as shown in FIG. 7 when the die D7 and the die D8 are disposed such that the axis N and the axis M deviate from each other. In the case where the diameter of the second inner circumferential surface 15 of the axial hole 2 is designed to have the minimum diameter necessary for inserting the large-diameter portion 19, there arises a possibility that the center electrode 4 cannot be inserted into the axial hole 2 because the projection portion 20 projects in the radial direction.

Also, in order that the hollow 33 is less likely to be formed on the projection portion 20, the value of (B−A) is desirably a somewhat large value. As shown in section (g) of FIG. 4, in the step of forming the projection portion 20 and the large-diameter portion 19, after the fourth combined body 78 is inserted into the round hole d7 of the die D7 and the die D8 is disposed thereon, the fourth combined body 78 is pressed by the punch P7 until the rear end portion of the fourth combined body 78 plastically deforms and fills the round hole d71. At that time, if the pressing operation is continued after the round hole d71 of the die D7 has been filled with the fourth combined body 78, the die D7 may break. Accordingly, the pressing operation is ended when the round hole d71 is filled with the fourth combined body 78. In the case where the value of (B−A) is close to 0; i.e., the diameter of the large-diameter portion 19 is almost the same as that of the projection portion 20, the round hole d8 of the die D8 may not be filled with the fourth combined body 78 although the round hole d71, which is greater in diameter than the round hole d7, is filled with the fourth combined body 78. A region which is not filled with the fourth combined body 78 becomes a hollow 33 on the projection portion 20.

Figure 8:
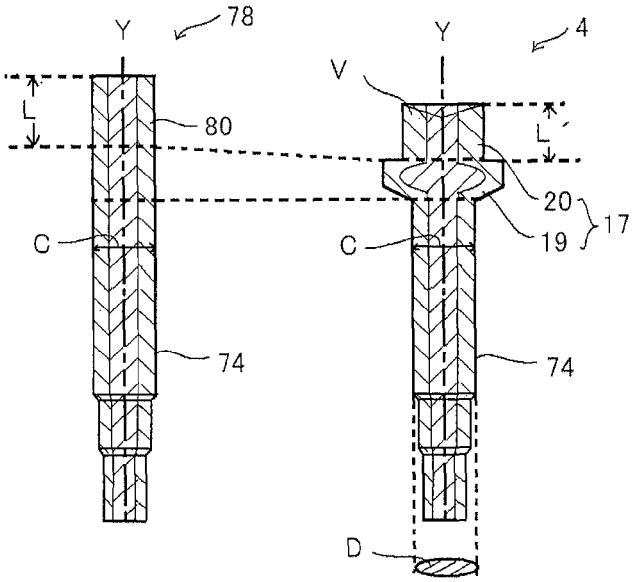
FIG. 8 is a pair of explanatory views used for explaining upsetting ratio.

The center electrode 4 of the spark plug of the present invention satisfies the following requirement. FIG. 8 shows the dimensions, etc. of the fourth combined body 78 and the center electrode 4. When the value (L'/C) obtained by dividing the axial length L' of the projection portion 20 by the average diameter C of the leg portion 18 is 1 or greater (preferably, 3 or less), the upsetting ratio (L−L')/L×100(%) is 13% or less, wherein L represents a pre-formation projection portion length (V/D) obtained by dividing the volume V of the projection portion 20 by the cross-sectional area D of the leg portion 18. The upsetting ratio (L−L')/L×100 is the ratio of the difference (L−L') between the pre-formation projection portion length L and the axial length L' of the projection portion 20 to the pre-formation projection portion length L. When the above-mentioned relational expression is satisfied, the eccentricity a and the hollow depth b can be reduced further. As a result, there can be provided a spark plug in which the center electrode 4 is fixed to the wall surface of the axial hole 2 in a better condition.

The upsetting ratio represents the compression ratio of a portion of the fourth combined body 78 which forms the projection portions 20 when the fourth combined body 78 is compressed in the direction of the axis M by the punch P7 in the process of forming the projection portion 20 and the large-diameter portion 19 as shown in FIG. 4(*g*). When the value of (L'/C) is 1 or greater; the projection portion 20 becomes thicker than the leg portion 18. A projection portion forming portion 80 of the fourth combined body 78 which forms the projection portion 20 is compressed such that the upsetting ratio exceeds 13%, the diameter of the projection portion 20 becomes greater than that of the fourth combined body 78 by a predetermined percentage or greater. Since the diameter of the fourth combined body 78 is the same as the leg portion 18, the diameter of the projection portion 20 becomes greater than that of the leg portion 18 by a predetermined percentage or greater, and the eccentricity a and the hollow depth b may increase as described above.

The diameter A of the imaginary cylinder of the projection portion 20, the maximum diameter B of the large-diameter portion 19, and the average diameter C of the leg portion 18 can be measured by using a micrometer, and the axial length L' of the projection portion 20 can be measured by using a projector.

The above-mentioned diameter A can be determined as follows. The maximum width of the projection portion 20 as viewed from a direction perpendicular to the axis of the center electrode 4 is measured, and the same measurement is performed every time the center electrode 4 is rotated by 60°. The largest one of the measured widths is used as the diameter A. The above-mentioned maximum diameter B can be determined as follows. Diameters of the center electrode 4 along a plurality of radial directions as viewed from the rear end thereof are measured, and the largest one of the measured diameters is used as the maximum diameter B. The above-mentioned average diameter C of the leg portion 18 can be determined as follows. In the case where the diameter of the center electrode 4 changes at a plurality of locations as in the present embodiment, the average diameter of the thickest rod-shaped portion 74 of the leg portion 18 is measured. First, a position on the rod-shaped portion 74 which is 1 mm shifted rearward from the forward end thereof along the axis O is defined as a measurement start point. At this measurement start point, diameters of the leg portion 18 along two directions perpendicular to each other are measured. Similarly, the diameters of the leg portion 18 along the two directions are measured at 1 mm intervals from the measurement start point (at five points in total). The arithmetic average of the ten diameters measured at the ten points is used as the average diameter C.

Notably, the forward end of the large-diameter portion 19 corresponds to a position where the diameter starts to increase from the average diameter C of the leg portion 18 as viewed in the direction from the forward end toward the rear end of the center electrode 4. In other words, the forward end (with respect to the direction of the axis O) of a portion which is located near the boundary between the leg portion 18 and the large-diameter portion 19 and whose outer diameter is always greater than the average diameter C is defined as the forward end of the large-diameter portion 19. Also, the rear end of the large-diameter portion 19 corresponds to a position where the diameter starts to increase from the diameter A of the projection portion 20 as viewed in the direction from the rear end toward the forward end of the center electrode 4. In other words, the rear end (with respect to the direction of the axis O) of a portion which is located near the boundary between the projection portion 20 and the large-diameter portion 19 and whose outer diameter is always greater than the diameter A is defined as the rear end of the large-diameter portion 19.

The cross-sectional area D of the leg portion 18 can be calculated from the average diameter C of the leg portion 18. The volume V of the projection portion 20 can be obtained through calculation. The eccentricity a can be measured by using an eccentricity measurement device, and the hollow depth b can be measured by using a micrometer or a projector.

The spark plug according to the present invention is used as an ignition plug for an internal combustion engine (e.g., gasoline engine) for automobiles. The above-described screw portion of the spark plug is screwed into a threaded hole of a head (not shown) which defines combustion chambers of the internal combustion engine, whereby the spark plug is fixed at a predetermined position. The spark plug of the present invention can be used for any type of an internal combustion engine.

The spark plug according to the present invention is not limited to the above-described embodiment, and may be modified in various manner so long as the object of the present invention can be achieved. For example, when the above-described requirement of the spark plug according to the present invention is satisfied, there can be provided a spark plug in which the center electrode is fixed within the axial hole in a good condition, irrespective of the screw diameter.

The shape of the head portion 17 of the center electrode 4 is not limited to that employed in the above-described embodiment. For example, the large-diameter portion and the projection portion may have a circular columnar shape or the shape of a hand drum. Also, the surfaces of the large-diameter portion and the projection portion may be threaded or knurled.

Noble metal tips 31 and 32 made of a platinum alloy, an iridium ally, or the like may be provided on the surface of the center electrode 4 and the surface of the ground electrode 8 which face each-other. Alternatively, a noble metal tip may be provided on only one of the center electrode 4 and the ground electrode 8. In the spark plug 1 of the present embodiment, the noble metal tips 31 and 32 are provided on both of the center electrode 4 and the ground electrode 8, and the spark discharge gap g is formed between the noble metal tips 31 and 32.

EXAMPLE

<Manufacture of the Center Electrode>

Center electrodes having the same shape as the center electrode shown in FIG. 1 were manufactured by the above-described manufacturing process. Center electrodes having various dimensions shown in Tables 1 and 2 were manufactured by changing the diameter (A) of an imaginary cylinder having the minimum diameter required for surrounding the projection portion, the maximum diameter (B) of the large-diameter portion, the average diameter (C) of the leg portion, the cross-sectional area (D) of the leg portion, the volume (V) of the projection portion, and the axial length (L') of the projection portion.

Of the above-mentioned various dimensions, the dimensions (A), (B), and (C) were measured by using a micrometer, and the dimension (L') was measured by using a projector as described above. The area (D) and the volume (V) were calculated from the measured dimensions. The projection portion had a circular columnar shape and had an inverted-conical recess at the rear end portion. The leg portion had a circular columnar shape and had a plurality of cylindrical portions having different diameters.

The manufactured center electrodes had a layered structure including a metal inner layer containing Cu as a main component, and a metal outer layer surrounding the inner layer and containing Ni as a main component.

<Relation Between the Dimensions of the Center Electrode and Eccentricity and Hollow Depth>

For the manufactured center electrodes, the eccentricity (a) was measured by using an eccentricity measurement device (main body: a product of Universal Punch Corp, model K1-10; dial test indicator: a product of Mitutoyo Corporation, model TI-123H), and the hollow depth (b) was measured by using a projector. Table 1 shows the results of the measurements.

As shown in Table 1, the greater the value of (B−A)−(A−C), the smaller the eccentricity (a) and the hollow depth (b). When the eccentricity (a) becomes equal to or greater than the value of (B−A)/2 and the axis X deviates from the axis Y by an amount equal to or greater than the value of (B−A)/2, as shown in FIG. 7, the projection portion projects from the end surface of the large-diameter portion in the radial direction. In such a case, the insertion of the center electrode into the axial hole may become difficult, and uniform charging of the seal powder may become difficult. Accordingly, with the value of the (B−A)/2 being used as a tolerance for the eccentricity (a), the eccentricity (a) became smaller than the tolerance when the value of (B−A) (A−C) was equal to or greater than 0.

In the spark plug of the present invention which includes a center electrode having a reduced eccentricity (a) and a reduced hollow depth (b), since the seal is formed around the projection portion such that it becomes uniform in the circumferential direction, the center electrode can be fixed within the axial hole in a good condition.

TABLE 1

| NO. | | Dimensions (mm) | | | | | | | | |
|---|---|---|---|---|---|---|---|---|---|---|
| | | A | B | C | (A − C) | (B − A) | (B − A) − (A − C) | Hollow depth (b) | Eccentricity (a) | Eccentricity tolerance (B − A)/2 |
| 1 | Examples | 2.7 | 3.4 | 2.6 | 0.1 | 0.7 | 0.6 | 0.03 | 0.02 | 0.35 |
| 2 | | 2.2 | 2.7 | 2.1 | 0.1 | 0.5 | 0.4 | 0.02 | 0.02 | 0.25 |
| 3 | | 2.8 | 3.4 | 2.6 | 0.2 | 0.6 | 0.4 | 0.05 | 0.03 | 0.3 |
| 4 | | 2.3 | 2.7 | 2.1 | 0.2 | 0.4 | 0.2 | 0.04 | 0.03 | 0.2 |
| 5 | | 2.9 | 3.4 | 2.6 | 0.3 | 0.5 | 0.2 | 0.07 | 0.04 | 0.25 |
| 6 | | 2.4 | 2.7 | 2.1 | 0.3 | 0.3 | 0.0 | 0.09 | 0.06 | 0.15 |
| 7 | | 3 | 3.4 | 2.6 | 0.4 | 0.4 | 0.0 | 0.12 | 0.07 | 0.2 |
| 8 | Comparative | 2.5 | 2.7 | 2.1 | 0.4 | 0.2 | −0.2 | 0.16 | 0.13 | 0.1 |
| 9 | Examples | 3.2 | 3.4 | 2.6 | 0.6 | 0.2 | −0.4 | 0.26 | 0.21 | 0.1 |
| 10 | | 2.6 | 2.7 | 2.1 | 0.5 | 0.1 | −0.4 | 0.34 | 0.28 | 0.05 |
| 11 | | 3.3 | 3.4 | 2.6 | 0.7 | 0.1 | −0.6 | 0.39 | 0.33 | 0.05 |

<Relation Between Upsetting Ratio and Eccentricity>

Various center electrodes were manufactured by changing the upsetting ratio, and the ratio (L'/C) of the axial length (L') of the projection portion to the average diameter (C) of the leg portion, and their eccentricities (a) were measured by using an eccentricity measurement device.

The upsetting ratio was calculated in accordance with the following equation.

$$(L-L')/L\times 100 \qquad \text{Equation}$$

The axial length (L') of the projection portion was measured by using a projector, and the pre-formation projection portion length (L) was obtained by, dividing the volume (V) of the projection portion by the cross-sectional area (D) of the leg portion. The volume (V) of the projection portion and the cross-sectional area (D) of the leg portion were obtained by calculation from the measured dimensions (A), (C), and (L'). The projection portion had a circular columnar shape and had an inverted-conical recess at the rear end portion. The leg portion had a circular columnar shape and had a plurality of cylindrical portions having different diameters. The results are shown in Table 2 and FIG. 9.

Figure 9:
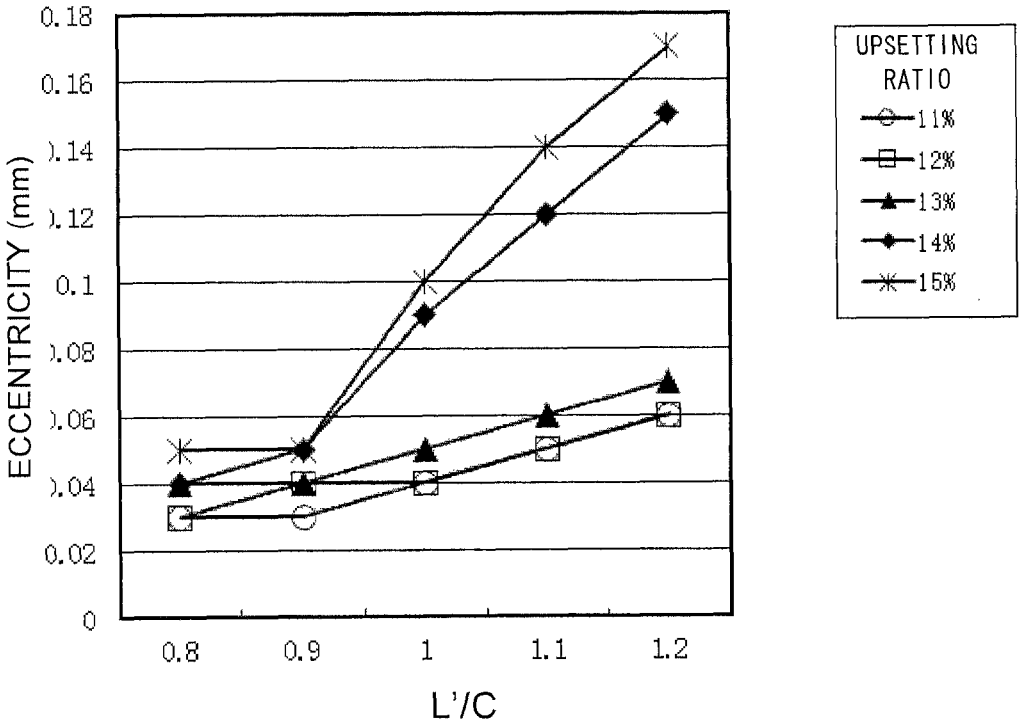
FIG. 9 is a graph showing the relation between L'/C and eccentricity.

As shown in FIG. 9, when the (L'/C) was 1 or greater, upsetting ratios equal to or less than 13% decreased the eccentricity (a), as compared with the case where the upsetting ratio was 14% or 15%. In the spark plug of the present invention which includes a center electrode having a reduced eccentricity (a), since the seal is formed around the projection portion such that it becomes uniform in the circumferential direction, the center electrode can be fixed within the axial hole in a good condition.

TABLE 2

| | Dimensions (mm) | | | | | |
|---|---|---|---|---|---|---|
| No. | A | C | (B − A) − (A − C) | L/C | Upsetting ratio (%) | Eccentricity (a) (mm) |
| 1 | 2.8 | 2.5 | 0.1 | 0.8 | 11 | 0.03 |
| 2 | 2.6 | 2.3 | 0.1 | | 12 | 0.03 |
| 3 | 3.3 | 2.9 | 0.1 | | 13 | 0.04 |
| 4 | 3.2 | 2.8 | 0.1 | | 14 | 0.04 |
| 5 | 3.0 | 2.6 | 0.1 | | 15 | 0.05 |
| 6 | 2.9 | 2.6 | 0.1 | 0.9 | 11 | 0.03 |
| 7 | 3.15 | 2.8 | 0.1 | | 12 | 0.04 |
| 8 | 3.15 | 2.8 | 0.1 | | 13 | 0.04 |
| 9 | 2.5 | 2.2 | 0.1 | | 14 | 0.05 |
| 10 | 2.4 | 2.1 | 0.1 | | 15 | 0.05 |
| 11 | 3.0 | 2.7 | 0.1 | 1 | 11 | 0.04 |
| 12 | 2.9 | 2.6 | 0.1 | | 12 | 0.04 |
| 13 | 3.15 | 2.8 | 0.1 | | 13 | 0.05 |
| 14 | 2.7 | 2.4 | 0.1 | | 14 | 0.09 |
| 15 | 3.4 | 3.0 | 0.1 | | 15 | 0.10 |
| 16 | 3.3 | 3.0 | 0.1 | 1.1 | 11 | 0.05 |
| 17 | 3.0 | 2.7 | 0.1 | | 12 | 0.05 |
| 18 | 2.9 | 2.6 | 0.1 | | 13 | 0.06 |
| 19 | 2.7 | 2.4 | 0.1 | | 14 | 0.12 |
| 20 | 2.6 | 2.3 | 0.1 | | 15 | 0.14 |
| 21 | 2.2 | 2.0 | 0.1 | 1.2 | 11 | 0.06 |
| 22 | 2.1 | 1.9 | 0.1 | | 12 | 0.06 |
| 23 | 2.9 | 2.6 | 0.1 | | 13 | 0.07 |
| 24 | 2.8 | 2.5 | 0.1 | | 14 | 0.15 |
| 25 | 2.7 | 2.4 | 0.1 | | 15 | 0.17 |

DESCRIPTION OF REFERENCE NUMERALS

1: spark plug
2: axial hole
3: insulator
4: center electrode
5: metallic terminal
6: seal
7: metallic shell
8: ground electrode
9: screw portion
10: flange portion
11: rod-shaped portion
12: talc
13: packing
14: first inner circumferential surface
15: second inner circumferential surface
16: ledge portion
17: head portion
18: leg portion
19: large-diameter portion
20: projection portion
21: resistor
22: second seal
23: diameter increasing portion
24: largest diameter portion
25: diameter decreasing portion
26: concave portion
27: outer layer
28: inner layer
30: forward end portion
31, 32: noble metal tip
33: hollow
41: circular columnar shell member
42: intermediate shell member
43: recess
45: forward end portion
46: cup-shaped shell member
51: circular columnar core member
52: circular columnar core member with head portion
61, 62, 63, 64, 65, 66, 67: forging apparatus
71: combined body
72: rear end portion
73: extrudate
74: rod-shaped portion
75: second combined body
76: small-diameter portion
77: third combined body
78: fourth combined body
79: intermediate diameter portion
80: projection portion forming portion
75: head portion forming portion

The invention claimed is:

1. A spark plug comprising:

an insulator having an axial hole extending in a direction of an axis, a first inner circumferential surface which forms a forward end portion of the axial hole, a second inner circumferential surface which forms a rear end portion of the axial hole and which has a diameter greater than that of the first inner circumferential surface, and a ledge portion which connects the first inner circumferential surface and the second inner circumferential surface;

a center electrode which is formed by plastic working, said center electrode having;

a large-diameter portion supported by the ledge portion, a projection portion projecting rearward from the large-diameter portion, and a circular columnar leg portion which is located adjacent to the large-diameter portion and projects into a space surrounded by the first inner circumferential surface; and a seal portion which fixes the center electrode within the axial hole, wherein, when $C<A$, $A-C \leq B-A$ where A represents a diameter (mm) of an imaginary cylinder having the minimum diameter required for surrounding the projection portion, B represents a maximum diameter (mm) of the large-diameter portion, and C represents an average diameter (mm) of the leg portion present in the space surrounded by the first inner circumferential surface, and when a value (L'/C) obtained by dividing an axial length L' of the projection portion along an axis by the average diameter C of the leg portion is 1 or greater, an upsetting ratio (L−L')/L×100(%) is 13% or less, where the upsetting ratio being the ratio of the difference (L−L') between a pre-formation projection portion length L and the axial length L' of the projection portion to the pre-formation projection portion length L, and the pre-formation projection portion length L being a value (V/D) obtained by dividing a volume V of the projection portion by a cross-sectional area D of the leg portion.

* * * * *